US005729934A

United States Patent [19]

Ochoa

[11] Patent Number: 5,729,934

[45] Date of Patent: Mar. 24, 1998

[54] METHOD AND APPARATUS FOR INTEGRATING VERTICAL RULE INTO CONSTRUCTION OF ROOM

[76] Inventor: Gino D. Ochoa, 107 N. Sycamore, Mesa, Ariz. 85201

[21] Appl. No.: 533,265

[22] Filed: Sep. 25, 1995

[51] Int. Cl.[6] ..... F04B 2/56; E04F 19/00; G01B 3/00

[52] U.S. Cl. ..... 52/105; 33/407; 33/411; 33/483; 52/254; 52/288.1; 52/417; 52/745.05

[58] Field of Search ..... 52/105, 254, 255, 52/256, 257, 287.1, 288.1, 417, 745.05, 745.09, 745.1, 745.13, 746.1, 747.1, 749.1, 750; 33/403, 404, 407, 405, 411, 427, 429, 483, 484, 490, 518, 526, 528, 571

[56] References Cited

U.S. PATENT DOCUMENTS

| | | | |
|---|---|---|---|
| 230,619 | 8/1880 | Darling | 33/490 |
| 1,614,577 | 1/1927 | Tetrick | 33/404 X |
| 2,118,598 | 5/1938 | Finke | 52/255 |
| 2,187,087 | 1/1940 | Leary | 52/105 X |
| 2,270,419 | 1/1942 | Debo | 52/105 |
| 2,528,211 | 10/1950 | Civkin et al. | 52/105 X |
| 2,851,741 | 9/1958 | Stemples | 52/255 |
| 3,374,589 | 3/1968 | Neal, Jr. | 52/105 |
| 4,924,644 | 5/1990 | Lewis | 52/105 |
| 4,927,696 | 5/1990 | Berg | 52/105 X |
| 5,428,929 | 7/1995 | Reese | 52/287.1 X |

FOREIGN PATENT DOCUMENTS

| | | | |
|---|---|---|---|
| 5457 | of 1907 | United Kingdom | 33/571 |

*Primary Examiner*—Carl D. Friedman
*Assistant Examiner*—Kevin D. Wilkens

[57] ABSTRACT

An L-shaped coping for drywall corners is marked with indicia to facilitate both installation of the coping and use of the coping as a permanently affixed rule.

1 Claim, 1 Drawing Sheet

METHOD AND APPARATUS FOR INTEGRATING VERTICAL RULE INTO CONSTRUCTION OF ROOM

This invention relates to a method and apparatus for measuring length and height.

More particularly, the invention relates to method for integrating into the construction of a room a vertically oriented permanently affixed rule which permits height and length to be measured during and after construction of the room.

In a further respect, the invention relates to coping which facilitates sizing of the coping to produce a vertically oriented rule for installation on a dry wall corner.

Tape measures and other measurement tools inscribed with units of length are frequently utilized by carpenters and other building trades during the construction of a building structure. While a tape measure is normally convenient to utilize, a carpenter ordinarily must utilize at least one hand to hold and operate the tape measure. During construction, many instances arise in which the carpenter would prefer having both hands free to hold onto a pencil, lumber, siding or another tool while making a measurement. Being able to make a measurement without having to take out and extend the tape measure would significantly speed up construction and reduce construction costs.

Accordingly, it would be highly desirable to provide a method and apparatus which would enable measurements to be rapidly made during construction without requiring that a tape measure or other rule be picked up and manually manipulated by a carpenter with the measurement is being taken.

It further would be highly desirable to provide a method and apparatus which would enable measurements to be rapidly made during construction and which could be integrated in the construction process to expedite the completion of construction.

Therefore, it is a principal object of the invention to provide an improved method and apparatus for constructing a room in a building structure.

A further object of the invention is to provide an improved method and apparatus which can be used to measure construction materials and which can be readily integrated into conventional construction processes.

Another object of the invention is to provide an improved measurement method and apparatus which enables a measurement to be made by a construction worker without requiring the use of either of the worker's hands to manipulate the measurement tool.

Still a further object of the invention is to provide an improved method and apparatus which can be used to expedite the construction of dry wall in a building structure.

These and other, further and more specific objects and advantages of the invention will be apparent to those skilled in the art from the following detailed description thereof, taken in conjunction with the drawings, in which.

Figure 1:
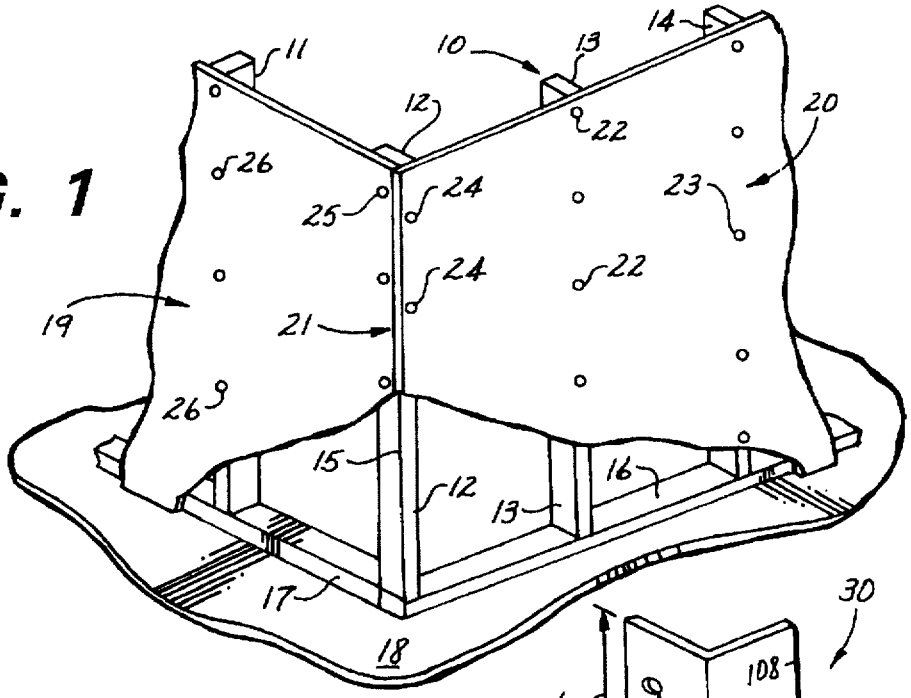
FIG. 1 is a perspective view illustrating in part a fixed vertically oriented rule and room structure constructed in accordance with the method and apparatus of the invention.

Briefly, in accordance with my invention, I provide a method for constructing a room. The method includes the steps of constructing a floor; constructing on the floor a framework of vertically oriented spaced apart support members, the support members defining a least two wall areas which meet at a corner; fastening wallboard to the support members in the wall areas such that wallboard in one of the wall areas coterminates at the corner with wallboard in the other of the wall areas to form a vertically extending edge; providing a length of L-shaped coping ruled in units of length; using the units of length to mark off a selected length on the L-shaped coping; cutting the L-shaped coping to the selected length to form a cut length of the L-shaped coping; placing the cut length of the L-shaped coping on the edge and conforming the coping to the edge; permanently affixing the cut length of the L-shaped coping to the edge such that the units of length on said cut length are visible; and, utilizing the permanently affixed cut length of L-shaped coping to measure for cutting other construction materials.

In another embodiment of my invention, I provide a method for constructing a fixed, vertically oriented rule. The method includes the steps of constructing a floor; constructing on the floor a framework of vertically oriented spaced apart support members, the members defining a least two wall areas which meet at a corner; fastening wallboard to the support members in the wall areas such that wallboard in one of the wall areas coterminates at the corner with wallboard in the other of the wall areas to form a vertically extending edge; providing a length of L-shaped coping ruled in units of length; using the units of length to mark off a selected length on said L-shaped coping; cutting the L-shaped coping to the selected length to form a cut length of the L-shaped coping; placing the cut length of the L-shaped coping on the edge and conforming the coping to the edge; and, permanently affixing the cut length of the L-shaped coping to the edge such that the units of length on the cut length are visible.

In still a further embodiment of the invention, I provide a method for constructing a room. The method includes the steps of constructing a floor; constructing on the floor a framework of vertically oriented spaced apart support members, the members defining a least two wall areas which meet at a corner; fastening wallboard to the support members in the wall areas such that wallboard in one of the wall areas coterminates at the corner with wallboard in the other of the wall areas to form a vertically extending edge; providing a length of L-shaped coping ruled in units of length; using the units of length to mark off a selected length on the L-shaped coping; cutting the L-shaped coping to the selected length to form a cut length of the L-shaped coping; placing the cut length of the L-shaped coping on the edge and conforming the coping to the edge; and, permanently affixing the cut length of the L-shaped coping to the edge.

In yet another embodiment of the invention, I provide a fixed, vertically oriented rule. The rule includes a floor; a framework of vertically oriented spaced apart support members extending upwardly from the floor and defining a least two wall areas which meet at a corner; wallboard fastened to the support members in the wall areas such that wallboard in one of the wall areas coterminates at the corner with wallboard in the other of the wall areas to form a vertically extending edge; and, a length of L-shaped coping ruled in units of length, the coping conforming and permanently affixed to the edge.

Turning now to the drawings, which depict the presently preferred embodiment of the invention for the purpose of illustrating the practice thereof and not by way of limitation of the scope of the invention, and in which like reference characters refer to corresponding elements throughout the several views, FIG. 1 illustrates a room construction and method in accordance with the invention. A floor 18 is constructed of concrete, wood, etc. using well known conventional construction methods. A framework 10 of vertically oriented spaced apart support members 11 to 14 is constructed on floor 18. A concrete wall or other vertically oriented support member can, if desired, be utilized in place of members 11 to 14. The lower end of each of members 11 to 14 is preferably connected to a footer 16, 17, but can, if desired, instead be connected directly to the floor 18. Members 11 to 14 define at least two planar wall areas which meet at corner 15. Wallboard 20 is placed in one of the wall areas and is nailed or otherwise fastened to members 12 to 14. In FIG. 1, wallboard 20 is held in place by nails 24 extending into member 12, by nails 22 extending into member 13, and by nails 23 extending into member 14. Wallboard 19 is placed in the other of the wall areas and is nailed or otherwise fastened to members 11 and 12. In FIG. 1, wallboard 19 is held in place by nails 25 extending into member 12 and by nails 26 extending into member 11. Wallboard 19 coterminates with wallboard 20 at corner 15 to form vertically extending edge 21.

Figure 2:
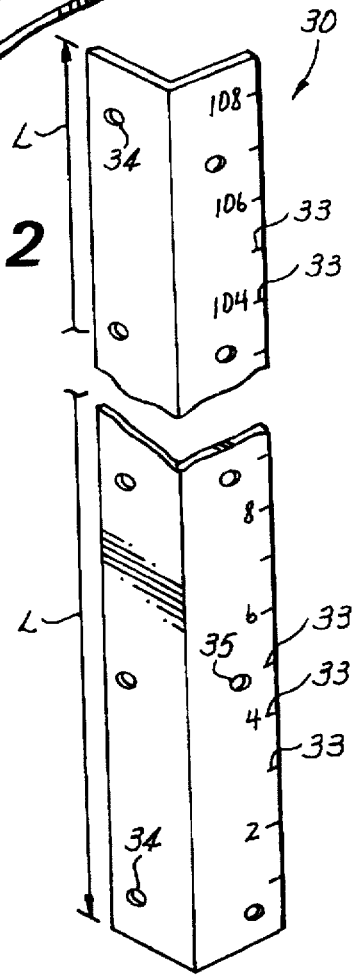
FIG. 2 is a perspective view illustrating a L-shaped coping constructed to be utilized in combination with the structure of FIG. 1 to form a fixed vertically oriented rule structure; and, FIG. 3 is a perspective view illustrating the structure of FIG. 1 after the coping of FIG. 2 has been conformed and permanently affixed thereto.

As shown in FIG. 2, L-shaped coping 30 has a length indicated by arrows L. While the length of coping 30 can vary as desired, in FIG. 2 coping 2 has a length slightly greater than one hundred and eight inches. Coping 30 is ruled in one inch units of length such that in FIG. 2 the numbers "2", "4", "6", "8", "104", "106", "108" indicates inches and each rule mark or indicia 33 is one inch apart from immediately adjacent rule marks 33. Coping 30 can be ruled with any desired units of length. Apertures 34, 35 are formed through the coping to facilitate nailing the coping in place at the corner 21 of a room wall structure.

If, for example, it is desired that coping 30 have a length of ninety-six inches, coping 30 is marked off at a length of ninety-six inches and is cut. Coping 30 can be marked off with a pencil or other inscription device or can be marked off visually by simply visually identifying the rule mark 33 adjacent the number ninety-six on coping 30.

After the coping 30 is marked off, it is cut to produce a piece of cut coping 30A having the desired length of ninety-six inches. The desired length of coping 30 can vary as desired.

Figure 3:
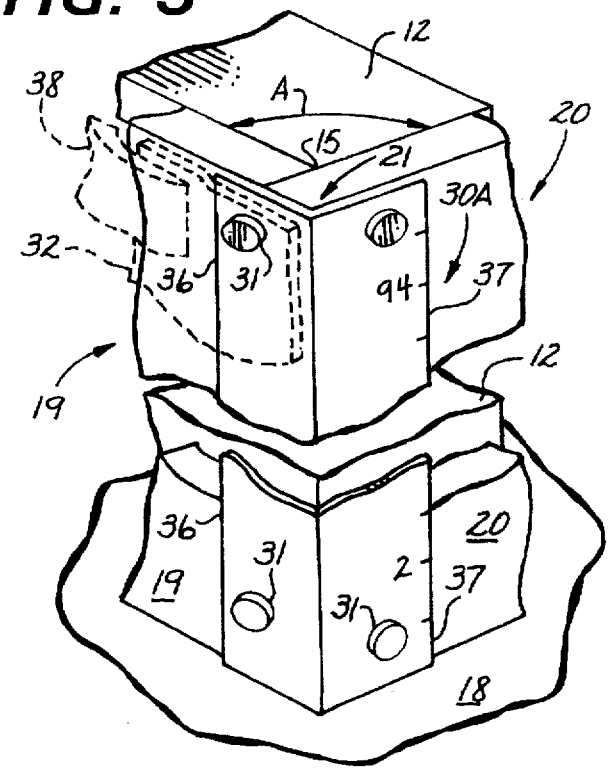

Coping 30A is turned to a vertical orientation and is then placed on and conformed to edge 21. Coping 0A can also, as would be appreciated by those of skill in the art, be placed in other orientations, for example, a horizontal orientation at the juncture of wallboard 20 and the ceiling, at the juncture of wallboard 20 and a window, etc. Coping 30A can be fabricated from plastic, metal, or any other desired material. Coping 30A is, however, often made of a thin bendable metal to facilitate conforming of the coping to the edge 21 of a wall. At edge 21, the coterminating pieces of wallboard are often normal to one another, but sometimes the angle A (FIG. 3) between two pieces of wallboard can be greater or less than ninety degrees, in which case coping 30A is bent or flexed to conform to edge 21. If angle A is ninety degrees, then, since the legs of L-shaped coping are typically perpendicular to one another, coping 30A conforms to edge 21 and little, if any, bending or flexing of the legs of coping 30A are required to conform the coping 30A to edge 21.

After coping 30A is conformed to edge 21, it is permanently affixed by pounding nails 31 through apertures 34, 35. Any desired means can be utilized to secure coping 30A in place. Coping 30A provides a vertically oriented permanently affixed rule. Coping 30A is used to measure for cutting the length of two-by-fours, plywood, or other construction materials. If desired, construction of the room can be completed by utilizing plasterboard tape 32 to cover up the edges 36 and/or 37 of coping 30A and by then painting the tape and wallboard. Further, if desired, wallboard grouting or plaster 38 can be spread or troweled over tape 32 and sanded prior to painting wallboard 19, 20. Tape, 32, plaster 38, and paint can partially or completely cover coping 30A. If it is desired to utilize coping 30A as a rule for an extended period of time, then during taping, plastering, and painting, the indicia 33 are left exposed.

One particular advantage of the invention is that it permits a rule structure to be integrated into conventional construction procedures. The rule structure of coping 30 not only facilitates and expedites the mounting of coping 30, but also produces a permanent vertically or horizontally oriented rule which can be used to measure for cutting other materials utilized during construction of the room or can be utilized for other projects after construction of the room is completed.

Having described my invention in such terms as to enable those skilled in the art to understand and practice it, and having identified the presently preferred embodiments thereof, I claim:

1. A method for constructing a room, comprising the steps of:

(a) constructing a floor;

(b) constructing on said floor a framework of vertically oriented support members, said members defining at least two wall areas which meet at a corner;

(c) fastening wallboard to said support members in said wall areas such that wall board in one of said wall areas coterminates at said corner with wallboard in the other of said wall areas to form a vertically extending edge;

(d) providing a length of L-shaped coping ruled in units of length and including numerical indicia formed thereon and associated with said units of length to indicate the distance defined by said units of length;

(e) using said units of length to mark off a selected length on said L-shaped coping;

(f) cutting said L-shaped coping to said selected length to form a cut length of said L-shaped coping;

(g) placing said cut length of said L-shaped coping on said edge and conforming said coping to said edge;

(h) permanently affixing said cut length of said L-shaped coping to said edge such that said units of length on said cut length are visible; and, (i) utilizing said permanently affixed cut length of L-shaped coping to measure for cutting other construction materials.

* * * * *